US006488174B1

(12) United States Patent
Cho

(10) Patent No.: US 6,488,174 B1
(45) Date of Patent: Dec. 3, 2002

(54) DISPENSER

(76) Inventor: Young Kook Cho, 2660 Barefiit La., Rowland Heights, CA (US) 91748

( * ) Notice: Subject to any disclaimer, the term of this patent is extended or adjusted under 35 U.S.C. 154(b) by 0 days.

(21) Appl. No.: 09/928,825

(22) Filed: Aug. 13, 2001

(51) Int. Cl.[7] ..... G07F 11/00
(52) U.S. Cl. ..... 221/7; 221/237; 221/266
(58) Field of Search ..... 221/154, 7, 200, 221/237, 266; 222/271, 274, 367

(56) References Cited

U.S. PATENT DOCUMENTS

| | | | | | |
|---|---|---|---|---|---|
| 2,138,232 | A | * | 11/1938 | Giannini | 221/266 |
| 2,153,694 | A | * | 4/1939 | Officer | 221/200 |
| 4,828,145 | A | * | 5/1989 | Raufast | 222/367 |
| 5,609,270 | A | * | 3/1997 | Walker | 221/266 |
| 5,860,563 | A | * | 1/1999 | Guerra et al. | 221/266 |
| 6,112,942 | A | * | 9/2000 | Deacon | 221/266 |
| 6,269,971 | B1 | * | 8/2001 | Nystrom et al. | 221/266 |

FOREIGN PATENT DOCUMENTS

| | | | | |
|---|---|---|---|---|
| DE | 959275 | * | 3/1957 | 221/266 |

* cited by examiner

*Primary Examiner*—H. Grant Skaggs
(74) *Attorney, Agent, or Firm*—Jerry H. Noh

(57) ABSTRACT

A container dispenser having a lid and a case housing is disclosed. The dispenser includes an outlet at a bottom portion of the case housing and communicating with a vertical passage, a wing rotating within the case housing and dropping articles into the vertical passage, a cylindrical framework receiving the article through the vertical passage and dropping the same into the outlet while making a rotation in the vertical transfer passage, a rotational means formed in an external portion of the case housing and sequentially rotating the wing and the cylindrical framework; and a sealing means for sealing the framework to prevent the ambient coming in through the outlet from being flowed into the housing.

8 Claims, 2 Drawing Sheets

DISPENSER

BACKGROUND OF THE INVENTION

1. Field of the Invention

The invention relates to a dispenser. More particularly, the present invention relates to an improved multi-purpose dispensing container which enables articles stored in the container to be sealed even when the articles are being discharged, thereby preventing deformation of the articles contained therein as well as facilitating article storage.

2. Description of Prior Art

In general, storage containers are widely used to store therein relatively small articles such as cigarettes, matches, tablets, toothpicks, sweets, sanitary chopsticks and disposable medical items. Conventional storage containers for these items includes a case housing and a lid, wherein the items are kept within the case housing. To use the conventional storage container, articles are placed within the case housing which is then covered by a lid to thus seal off the interior of the storage container.

However, although the sealing status of the conventional storage container may be reserved good when the lid is assembled to the case housing, the articles stored in the case housing has to be undesirably exposed to the ambient air in order for a user to pick out one of the articles from the case housing.

Further, when applied to sealing-required medical items such as tablets, cotton, and contraceptives, or to vapor-vulnerable items such as pasteurized spoons, matches, cigarettes, and toothpicks, these articles when contained in conventional storage containers has been subject to deformation since the those articles are inevitably exposed to the external environment whenever the lid is taken off There are other containers which don't require that a lid be taken off to dispense the contents therein. These other containers have a dispensing system which has a discharge hole defined at a lower end of the container for discharging items therethrough. The discharge of items through the hole is regulated by a covering or a single revolving door-like member at the hole. These containers are better at reducing exposure of the contents within the container to the ambient air by reducing the need to open the lid; however, air still seeps into the container through the hole.

SUMMARY OF THE INVENTION

The present invention is contrived to overcome the conventional disadvantages. Accordingly, it is an object of the present invention to provide an improved storage container system which enables the articles therein to be preserved from premature deformation by maintaining the interior of the container in a sealed-off status during an article discharge.

To achieve the above-described object, the storage container system according to the present invention comprises an outlet formed at a bottom portion of the case housing and communicating with a vertical passage formed within the case housing to facilitate an article discharge therethrough. Furthermore, a wing rotatably mounted within the case housing serves to drop articles into the vertical passage and to a cylindrical framework rotatably mounted within the case housing. The cylindrical framework receives the article dropped through the vertical passage and thereafter drops the same into the outlet while making a rotation in the vertical passage. A rotational means is formed in an external portion of the case housing and sequentially rotates the wing and the cylindrical framework in a predetermined rate of rotation. To effect sealing of the housing, a sealing means is utilized to seal the cylindrical framework and the wing to prevent the ambient atmosphere from flowing in through the outlet and into the case housing.

DETAILED DESCRIPTION OF THE PREFERRED EMBODIMENTS

With reference to the accompanying drawings, a multi-purpose container dispenser according to the present invention will now be described.

Figure 1:
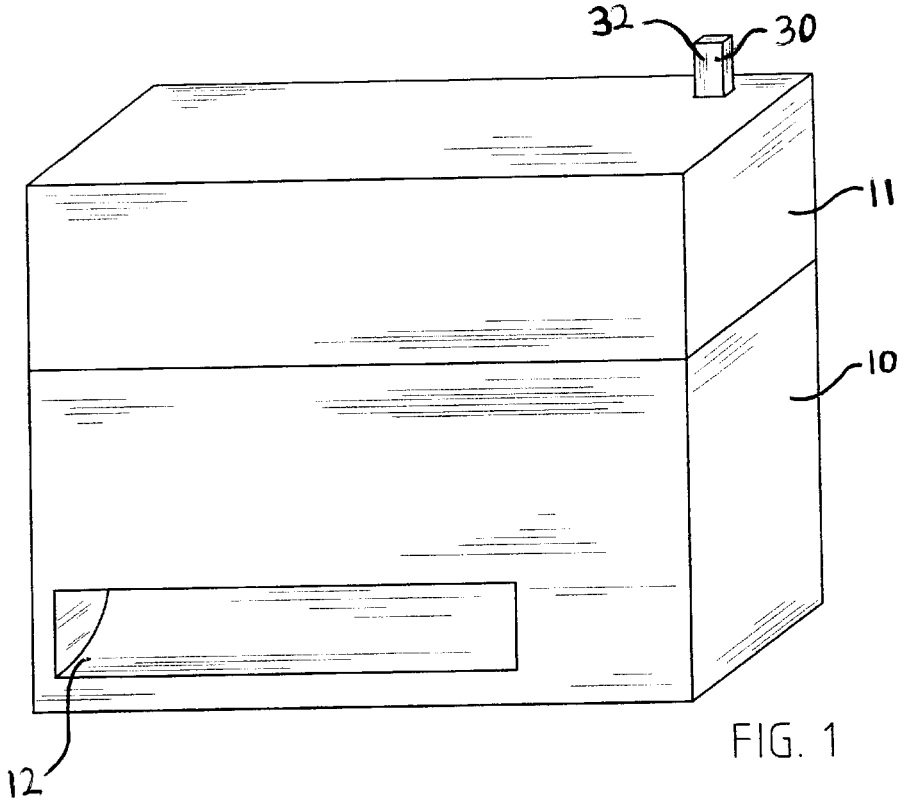
FIG. 1 is a perspective view of a multi-purpose storage container system according to the present invention.
Figure 2:
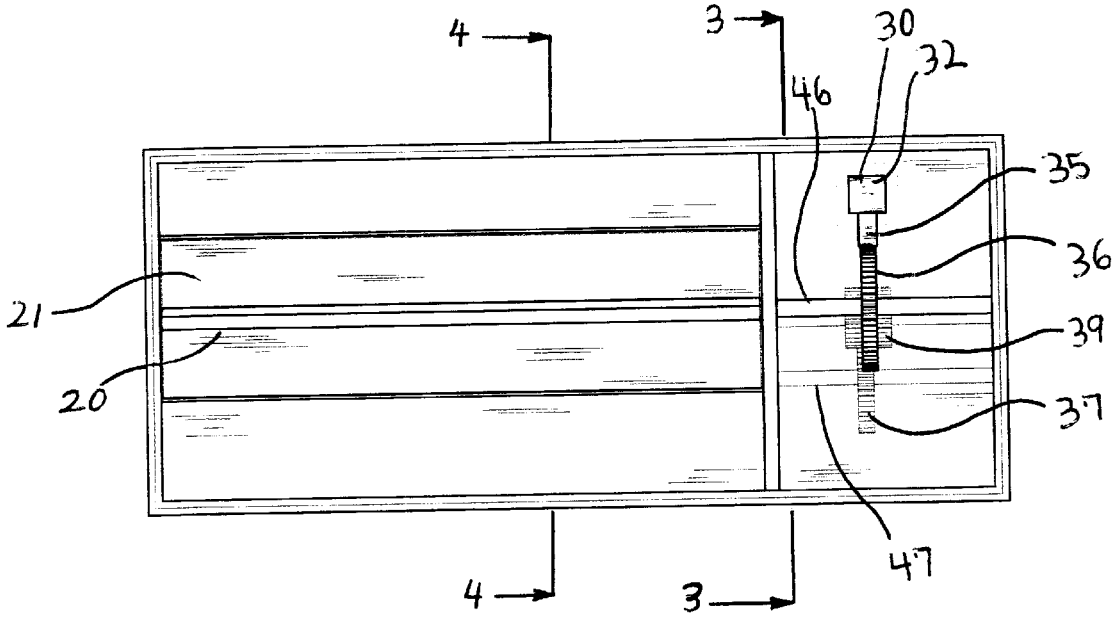
FIG. 2 is a top view of a multi-purpose storage container system according to the present invention shown here with the lid and downward slope of the case housing removed.

As shown in FIGS. 1 and 2, the container dispenser includes a case housing 10 having an internal space for storing therein miscellaneous articles and an opening at the top of the case housing 10. Further, the container dispenser has a lid 11 for sealing the interior of the case housing 10 by covering the opening of the case housing 10.

To a side portion of the case housing 10 is formed a activation pin 30 to discharge the articles stored in the case housing 10. To a lower front portion of the case housing 10 is formed an outlet 12 through which articles contained within the housing 10 are externally discharged.

Figure 3:
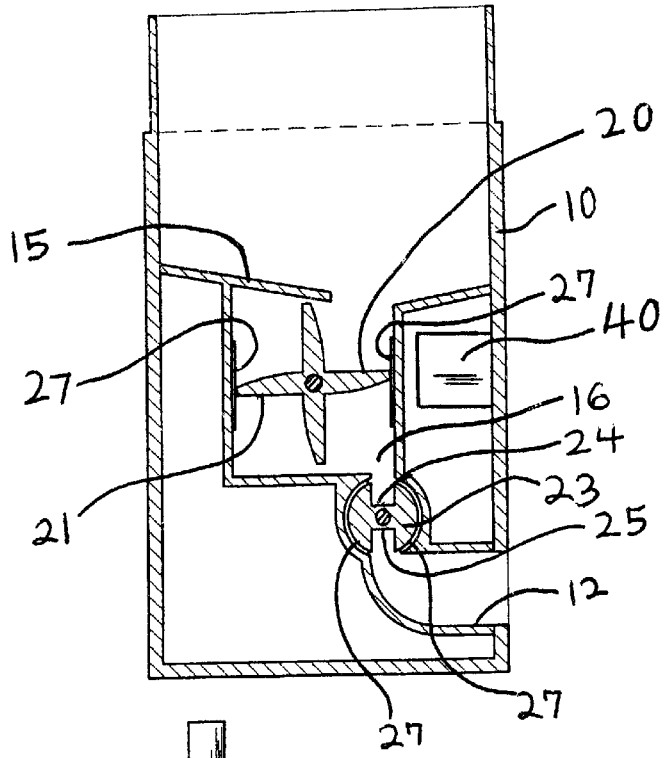
FIG. 3 is a cross sectional side view of the storage container system with the lid taken off and cut along the 3—3 line of FIG. 2.
Figure 4:
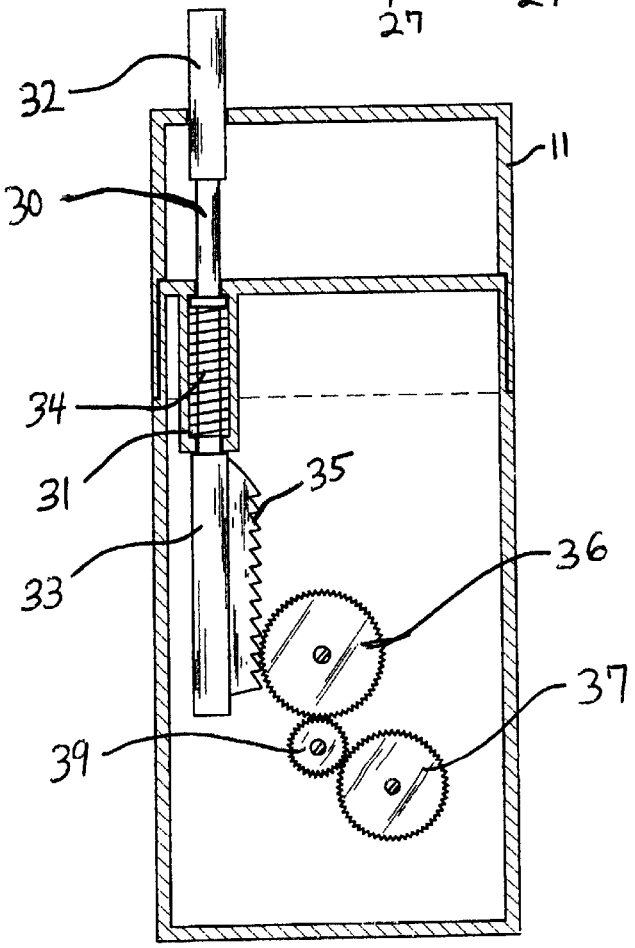
FIG. 4 is a cross-sectional side view taken along the line 4—4 line of FIG. 3.

Referring to FIGS. 3 and 4, an outlet means is formed adjacent to the internal space of the case housing 10 to externally discharge the articles received in the internal space through the outlet 12 in accordance with operation of the activation pin 30.

The outlet means includes a wing 20 and a cylindrical framework 23. The wing 20 has a plurality of evenly spaced arms 21 each of which serves to push the articles stored on a downward slope 15 of the case housing 10 and to drop the articles into a vertical passage 16. The cylindrical framework 23 leveled lower than the wing 20 is provided at a lower portion of the vertical passage 16 which communicates via the cylindrical framework 23 with the outlet 12. The cylindrical frame 23 temporarily holds therein the articles dropped through the vertical passage from the slope 15 in accordance with the revolution of the wing 20.

The cylindrical framework 23 is provided with first and second openings 24, 25 which oppose each other by an axial panel of the framework 23. The cylindrical framework 23 rotates within the vertical passage 16 and receives in one of the opposed openings 24, 25 the article dropped through the vertical passage 16 by the wing 20. When the cylindrical framework 23 rotates further, the article received in one of the openings 24, 25 is dropped into the outlet 12 and at the same time another article becomes dropped into the other of the openings 24, 25.

For a better performance, it is preferred that a sealing means is disposed on certain predetermined portions of the case housing 10. Once such portion is the portion of the case housing 10 to which the outer periphery of the cylindrical framework 23 abuts. Another such portion is the portion of the case housing to which the wing 20 abuts. A sealing rubber 27 may be employed for the sealing means. The sealing rubber 27 surrounds the outer periphery of the cylindrical framework 23 and the wing 20. The sealing rubber 27 can be a silica gel filled rubber sac.

With reference to FIG. 4 an activation pin 30 serves as part of a gear assembly for externally discharging articles contained in the case housing 10. The gear assembly further includes a button pin cap 32 making a vertical movement according to a vertical momentum, a plurality of latch teeth 35 formed along an operational shaft 33 which is connected to a lower portion of the activation pin 30, a first gear 36 changing the vertical movement of the operational shaft 33 to a rotational movement, a second gear 37 formed on a side of the first gear 36, and a linking gear 39 engaged between and linking the second gear 36 and first gear 36. An operational rod 46 of the wing 20 connects the wing to the first gear 36, and an operational rod 47 of the cylindrical framework connects the cylindrical framework 23 to the second gear 37.

In this construction, when the activation pin 30 is pushed, the vertical momentum generated thereby serves to rotate the first and second gears 36, 37 which subsequently serve to rotate the wing 20 and the cylindrical framework 23, thereby enabling the article discharge from the case housing 10.

As shown back in FIG. 4, the activation pin 30 is insertedly installed in an installation cavity 31 formed in a side portion of the case housing 10. The activation pin 30 includes the button cap 32 and an operation shaft 33 with the plurality of latch teeth 35 formed thereon. A coil spring 34 is provided between a lower portion of the button cap 32 and the installation cavity 31 so that the button cap 32 can be restored to its original position after the button pushing.

According to the vertical movement of the push button 30, the first and second gears 36, 37 become sequentially rotated to thereby generate each rotation of the cylindrical framework 23 and the wing 20. That is, the received articles are sequentially discharged by the first and second gears 36, 37.

In an embodiment, it is recommended that the reciprocal movement of the activation pin 32 allows the cylindrical framework 23 to make a half (½) rotation so that one of the first and second openings 24, 25 can receive the article therein. By another half rotation of the cylindrical framework 23 the article received in the one of the openings 24, 25 is dropped into the outlet 12.

Also, it is desirable that the wing 20 rotates to communicate properly with the half rotation of the cylindrical framework 23 per reciprocal movement of the activation pin 30. The rotation of the wing 20 depends on the number of evenly spaced arms 21 placed on the wing 20. For a wing 20 having three arms 21, the wing 20 should rotate ⅓ of a single rotation per reciprocal movement of the activation pin 30. For an embodiment having 4 arms 21, the wing 20 should rotate ¼ of a single rotation per reciprocal movement of the activation pin 30. Thus, where Y equals the number of arms 21, the fraction of a single rotation per reciprocal movement of the activation pin 30 equals 1/Y. The number of arms 21 varies according to the type of article held within the housing 10. The predetermined fractional rotation of the wing 20 ensures that a single reciprocal movement of the activation pin 30 limits the wing 20 to drop only a single article at a time into the vertical passage 16, whereby the article becomes placed on one of the first and second openings 24, 25 of the cylindrical framework 23.

The various fractional rotations of the cylindrical framework 23 and the wing 20 in relation to a single reciprocal movement of the activation pin 30 is determined by creating the radius and number of teeth on the first and second gears 36, 37 and linking gear 39 in a predetermined manner to create the desired rotations.

The thusly constituted container dispenser according to the present invention allows the articles received in the case housing 10 to be externally discharged without opening the lid 11, thereby securing the storage of articles requiring a constantly sealed condition. That is, in a state in which the articles are received within the case housing 10 and the lid 11 is covered, the button cap 30 is pushed to externally discharge the received articles.

More specifically, if the activation pin 30 is pushed once, the second gear 37 and the cylindrical framework 23 makes a half rotation and drops the article from one of the first and second openings 24, 25 into the outlet 12 while the other of the first and second openings 24, 25 receives therein another article being dropped from the vertical passage 16.

For example, when the cylindrical framework 23 makes a half rotation to guide the first opening 24 toward the outlet 12, the received articles serve to be dropped into the vertical passage 16 and the second receiving opening 25 becomes located toward the vertical passage 16 to receive therein the article being dropped from the vertical passage 16.

The cylindrical framework 23 consecutively makes a half rotation to load in one of the first and second openings 24, 25 the article being dropped from the vertical passage 16 and at the same time discharge from the other of the first and second openings 24, 25 the loaded article.

Also, when the first gear 36 rotates by a fraction of a full rotation thereof, the wing 20 rotates by the same fractional rotation thereof in accordance therewith. Accordingly, the arm 21 of the wing 20 moves the article placed on the slope 15 into the vertical passage 16 to thereby load the article into either the first opening 24 or the second opening 25 of the cylindrical framework 23.

Likewise, the wing 20 serves to push the articles placed on the slope 15 into the vertical passage 16 by its rotation and load each article in the first and second openings 24, 25 of the cylindrical framework 23. Through the repeated steps as such, the received articles are being maintained in a sealed status within the case housing 10 during the whole discharge process. That is, in a state in which the sealing members 27 serves to protect the ambient atmosphere from flowing into the case housing 10. Although the outlet 12 stays open, the ambient atmosphere is sealed off by the sealing members 27 covering the outer periphery of the cylindrical framework 23, whereby the interior of the case housing 10 is maintained in a sealed status during the discharge of each article.

Further, a counter 40 may be formed on the case housing 10 to count articles being discharged through the outlet 12 in accordance with the pressing of the activation pin 30 of the container dispenser according to the present invention.

As described above, the multi-purpose container dispenser according to the present invention maintains the interior of the case housing in a sealed status during the article discharge process, thereby improving storage safety for articles requiring a sealed status, such as tablets, disposable medical gloves, sanitary cottons, contraceptives, toothpicks, cigarettes, matches, sweets, sanitary chopsticks and the like. Also, the container dispenser enables an accurate counting of the articles stored therein.

Although a preferred embodiment of the invention has been described and illustrated for purposes of clarity and example, it should be understood that many changes, substitutions and modifications to the described embodiment will be apparent to those having skill in the art in light of the foregoing disclosure without departing from the scope and spirit of the present invention which is defined by the claims which follow.

What is claimed is:

1. A container for housing and dispensing miscellaneous items therein, said container comprising:

a main case housing having a removeable top lid;

a main storage compartment defined within said case housing;

an outlet at a bottom portion of said case housing;

a lower vertical passage defined within said case housing;

a wing rotating within the case housing for receiving said item held in said storage compartment, said wing disposed above said lower vertical passage and dropping articles into said vertical transfer passage;

a rotating cylindrical framework disposed within the case housing below said wing and within said vertical transfer passage; said cylindrical framework receiving said article dropped from said wing through the vertical transfer passage; said cylindrical framework dropping said same item into said outlet while making a rotation; and, a gear assembly formed in an external portion of the case housing and sequentially rotating the wing and the cylindrical framework.

2. The container as described in claim 1 further comprising a sealing member disposed between said cylindrical framework and said vertical transfer passage, and further comprising a sealing member disposed between said wing and said portion of said case housing adjacent said wing; said sealing member providing sealing within said case housing to prevent the ambient atmosphere from entering through said outlet and flowing into the storage compartment.

3. The container as described in claim 2 wherein said sealing member is made of a silica gel filled rubber sac.

4. The container as described in claim 1 further wherein the gear assembly comprises:

an activation pin making a vertically reciprocating movement within an installation opening formed in a side portion of the case housing;

a plurality of latch teeth formed along a lower portion of an operation shaft extending from the activation pin;

a first gear engaged to the latch teeth and transferring the vertical movement of the pin to a rotational movement, wherein an operational rod of the wing is attached to the first gear;

an operational rod of said cylindrical framework attached to said second gear;

said second gear and said first gear linked by a linking gear disposed therebetween.

5. The container as described in claim 1 wherein a counter is connected to the gear assembly to count quantity of items being discharged through the outlet.

6. A container for housing and dispensing miscellaneous items therein, said container comprising:

a main case housing having a removeable top lid;

a main storage compartment defined within said case housing;

an outlet at a bottom portion of said case housing;

a lower vertical passage defined within said case housing;

a wing rotating within the case housing for receiving said item held in said storage compartment, said wing disposed above said lower vertical passage and dropping articles into said vertical transfer passage;

a rotating cylindrical framework disposed within the case housing below said wing and within said vertical transfer passage; said cylindrical framework receiving said article dropped from said wing through the vertical transfer passage; said cylindrical framework dropping said same item into said outlet while making a rotation;

a gear assembly formed in an external portion of the case housing;

an operational rod of said wing connecting to a first gear forming part of said gear assembly;

an operational rod of said cylindrical framework connecting to a second gear forming part of said gear assembly;

said gear assembly sequentially rotating said first gear and said second gear to rotate said wing and said cylindrical framework;

a sealing member disposed between said cylindrical framework and said vertical transfer passage, and a sealing member disposed between said wing and said portion of said case housing adjacent said wing;

said sealing member providing sealing within said case housing to prevent the ambient atmosphere from entering through said outlet and flowing into the storage compartment.

7. The container as described in claim 6 wherein a counter is connected to the gear assembly to count quantity of items being discharged through the outlet.

8. The container as described in claim 6 wherein said sealing member is made of a silica gel filled rubber sac.

* * * * *